US007644521B2

(12) United States Patent
McCarron

(10) Patent No.: US 7,644,521 B2
(45) Date of Patent: Jan. 12, 2010

(54) FOOTWEAR WITH REST SUPPORT

(75) Inventor: Michael P. McCarron, Danville, CA (US)

(73) Assignee: Ariat International, Inc., Union City, CA (US)

( * ) Notice: Subject to any disclaimer, the term of this patent is extended or adjusted under 35 U.S.C. 154(b) by 487 days.

(21) Appl. No.: 11/397,060

(22) Filed: Apr. 3, 2006

(65) Prior Publication Data

US 2007/0227046 A1 Oct. 4, 2007

(51) Int. Cl.
*A43B 13/14* (2006.01)

(52) U.S. Cl. ..... 36/136; 36/103; 36/25 R

(58) Field of Classification Search ..... 36/136, 36/59 R, 25 R, 103; D2/953, 960
See application file for complete search history.

(56) References Cited

U.S. PATENT DOCUMENTS

| | | | | | |
|---|---|---|---|---|---|
| 2,545,910 | A * | 3/1951 | Aprile | ..... | 36/132 |
| D190,162 | S * | 4/1961 | Hubbard | ..... | D2/960 |
| 3,006,085 | A * | 10/1961 | Bingham, Jr. | ..... | 36/59 C |
| 3,619,916 | A * | 11/1971 | Neri | ..... | 36/59 R |
| 4,155,179 | A * | 5/1979 | Weninger | ..... | 36/117.4 |
| 4,291,473 | A * | 9/1981 | Sartor | ..... | 36/132 |
| 4,982,737 | A * | 1/1991 | Guttmann | ..... | 36/140 |
| 5,077,916 | A * | 1/1992 | Beneteau | ..... | 361/114 |
| 5,704,256 | A * | 1/1998 | De Lattre | ..... | 74/594.6 |
| 5,918,385 | A * | 7/1999 | Sessa | ..... | 36/59 C |
| 6,272,773 | B1 * | 8/2001 | Sjosvard | ..... | 36/131 |
| 6,311,416 | B1 * | 11/2001 | Cohen | ..... | 36/136 |
| 6,792,703 | B2 * | 9/2004 | Cohen | ..... | 36/136 |
| 2004/0177532 | A1 * | 9/2004 | Lawrence | ..... | 36/136 |

* cited by examiner

*Primary Examiner*—Ted Kavanaugh
(74) *Attorney, Agent, or Firm*—Cooley Godward Kronish LLP

(57) ABSTRACT

Footwear includes a sole with a forefoot region, a heel region, and a mid-sole region positioned between the forefoot region and the heel region. A support structure is positioned within the mid-sole region. The support structure is configured to engage an object to facilitate resistance to gravitational pull.

5 Claims, 1 Drawing Sheet

FOOTWEAR WITH REST SUPPORT

BRIEF DESCRIPTION OF THE INVENTION

The present invention relates generally to footwear. More particularly, the present invention relates to footwear to facilitate rest support.

BACKGROUND OF THE INVENTION

When sitting, many people like to extend their legs and rest them on a raised object. Typically, the object supports the individual's heels. This may result in heel fatigue. In addition, depending upon the individual's position, it may require a relatively awkward movement to remove the feet from the raised object.

In view of the foregoing, it would be desirable to provide an alternative technique for resting the legs of an individual, particularly an individual in a sitting position.

SUMMARY OF THE INVENTION

The invention includes footwear with a sole having a forefoot region, a heel region, and a mid-sole region positioned between the forefoot region and the heel region. A support structure is positioned within the mid-sole region. The support structure is configured to engage an object to facilitate resistance to gravitational pull.

BRIEF DESCRIPTION OF THE DRAWINGS

For a better understanding of the nature and objects of the invention, reference should be made to the following detailed description taken in conjunction with the accompanying drawings, in which.

DETAILED DESCRIPTION OF THE INVENTION

Figure 1:
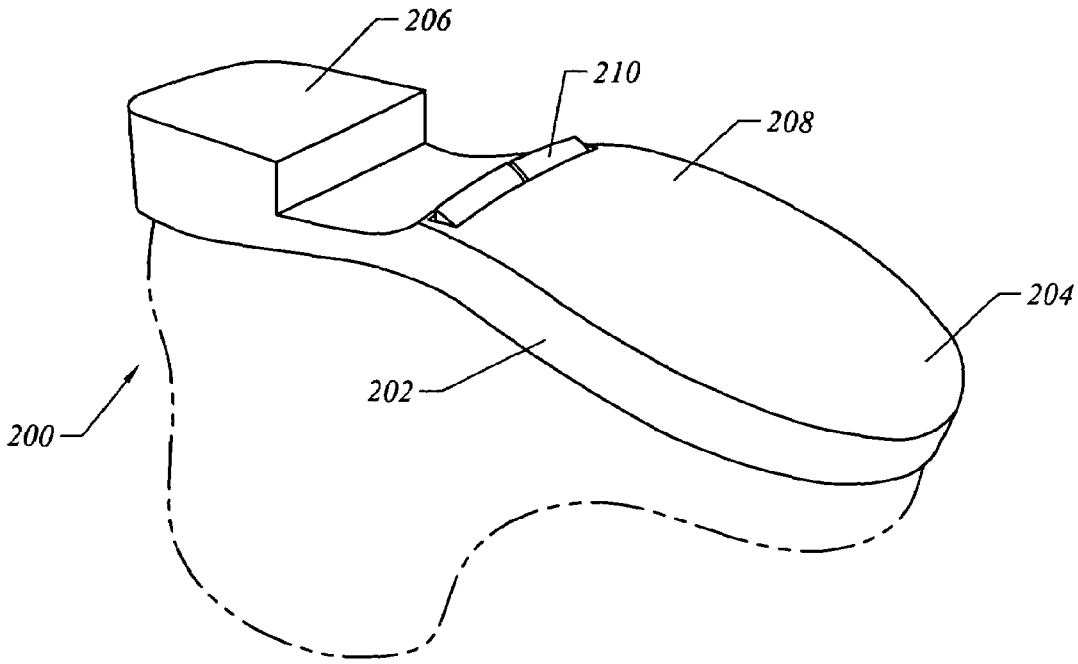
FIG. 1 is a perspective view of footwear configured in accordance with an embodiment of the invention.

FIG. 1 is a perspective view of footwear 200 configured in accordance with an embodiment of the invention. The footwear includes a sole 202 with a forefoot region 204 and a heel region 206. Positioned between the forefoot region 204 and the heel region 206 is a mid-sole region 208. In accordance with the invention, a support structure 210 is positioned within the mid-sole region 208. The support structure 210 is configured to engage an object and thereby allow an individual to rest a foot on the object. The support structure 210 is particularly useful when an individual is in a sitting position and wishes to engage his or her feet with an object. The support structure 210 is also useful if an individual is standing and desires to rest a leg on an object.

Figure 2:
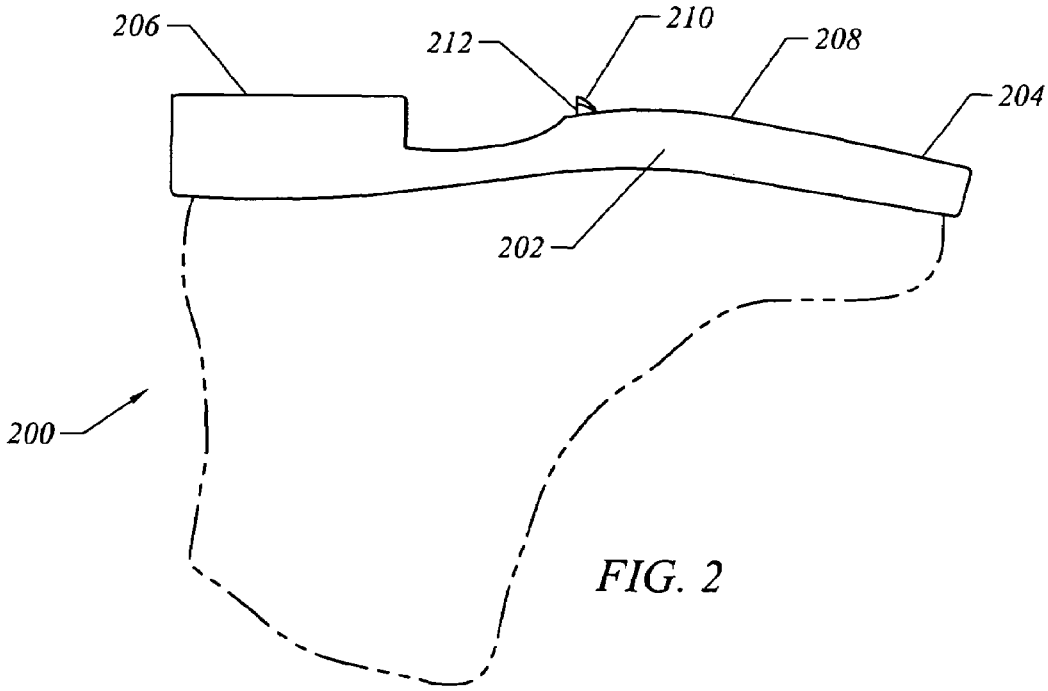
FIG. 2 is a side view of footwear configured in accordance with an embodiment of the invention.

FIG. 2 is a side view of the footwear 200. FIG. 2 illustrates that the support structure 210 includes an engagement surface 212 that is perpendicular, or substantially perpendicular, to the plane defined by the sole 202. The engagement surface 212 provides a mechanism for physical engagement with an object so that the footwear may be used to hold a user's foot on the object. More particularly, the engagement surface 212 is configured to engage an object in a manner that allows the support structure 210 to resist gravitational pull. As a result, the user is allowed to position his or her feet with reduced energy devoted to maintaining the feet in a stationary position. Thus, the support structure 210 operates to maintain the user's foot in a single position with reduced effort on behalf of the user. The configuration of the support structure 210 also allows a user to easily disengage from the object.

The support structure 210 may be formed integrally with the shoe sole 202. Alternately, the support structure 210 may be attached to the shoe sole 202 using an adhesive of fastening device. The support structure 210 may be formed of rubber, leather, and/or other shoe sole compositions. Preferably, the support structure 210 is positioned in the mid-sole region 208 so as not to inhibit the user's normal motion when walking. Observe that in this embodiment of the invention, the support structure 210 has a curved surface extending toward the forefoot region 204. This curved surface facilitates a normal walking motion.

The footwear 200 is particularly useful in connection with a motorcycle. A motorcycle typically includes mounts for the user's feet. As used herein, a mount refers to any motorcycle structure capable of supporting a user's feet. The mount may be a platform upon which a user rests the sole of a foot. Alternately, the mount may be a peg upon which a user rests the sole or heel of a foot. While the footwear 200 is particularly useful in connection with motorcycles, it may also be used in connection with household furniture, horse riding equipment, and the like.

The invention provides footwear to facilitating resting of a user's legs. The footwear allows a user to keep feet and legs in place without constant tension. This reduces leg fatigue. This may be important in any number of contexts, including long motorcycle trips.

The support structure is separate from any tread structure formed on the sole of the shoe. Indeed, the support structure should not regularly engage the ground when an individual is walking.

While the present invention has been described with reference to the specific embodiments thereof, it should be understood by those skilled in the art that various changes may be made and equivalents may be substituted without departing from the true spirit and scope of the invention as defined by the appended claims. In addition, many modifications may be made to adapt a particular situation, material, composition of matter, method, process step or steps, to the objective, spirit and scope of the present invention. All such modifications are intended to be within the scope of the claims appended hereto.

What is claimed is:

1. Footwear, comprising:

a sole with a forefoot region, a heel region, and a mid-sole region positioned between the forefoot region and the heel region, wherein the forefoot region and heel region each has a substantially smooth surface; and a single support structure positioned within the mid-sole region and projecting beyond any surface feature of the forefoot region, wherein the support structure has an engagement surface substantially perpendicular to the mid-sole region and a curved surface that extends toward the forefoot region such that the support structure does not regularly engage the ground during walking, and wherein the support structure is configured to engage an object to facilitate resistance to gravitational pull and thereby allow an individual to rest a foot on the object.

2. The footwear of claim 1, wherein the support structure is positioned in the midsole region so as not to obstruct a natural walking motion.

3. The footwear of claim 1, wherein the support structure is integrally formed with the sole.

4. The footwear of claim 1, wherein the support structure is attached to the sole.

5. The footwear of claim 1, wherein the support structure is configured to engage at least one of: a motorcycle mount, household furniture, and horse riding equipment.

* * * * *